US006266903B1

(12) United States Patent
Collins

(10) Patent No.: US 6,266,903 B1
(45) Date of Patent: Jul. 31, 2001

(54) HAND-HELD PORTABLE ROAD SIGN

(75) Inventor: Raymond V. Collins, Jefferson, OR (US)

(73) Assignee: Flaggin, Inc., Portland, OR (US)

( * ) Notice: Subject to any disclaimer, the term of this patent is extended or adjusted under 35 U.S.C. 154(b) by 0 days.

(21) Appl. No.: 09/496,316

(22) Filed: Feb. 1, 2000

(51) Int. Cl.[7] ..... G08B 24/00

(52) U.S. Cl. ..... 40/586; 40/547; 116/63 P; 340/908

(58) Field of Search ..... 40/586, 602, 603, 40/607, 612, 547; 116/63 P; 362/109; 340/908

(56) References Cited

U.S. PATENT DOCUMENTS

| | | | | |
|---|---|---|---|---|
| 1,658,883 | | 2/1928 | Cole . | |
| 1,820,157 | * | 8/1931 | Prochazka | 40/602 |
| 2,887,983 | | 5/1959 | Budd . | |
| 3,810,091 | | 5/1974 | Hoover . | |
| 4,019,271 | | 4/1977 | Latimer . | |
| 4,042,919 | | 8/1977 | Patty . | |
| 4,937,962 | * | 7/1990 | Hornblad | 40/604 |
| 5,023,607 | | 6/1991 | Staten . | |
| 5,062,380 | | 11/1991 | Chestnutt . | |
| 5,103,581 | * | 4/1992 | Novak | 40/547 |
| 5,276,424 | | 1/1994 | Hegemann . | |
| 5,440,464 | * | 8/1995 | Nowlin et al. | 362/109 |
| 5,694,110 | * | 12/1997 | Clifford | 340/908 |
| 5,755,051 | | 5/1998 | Zumbuhl . | |

* cited by examiner

*Primary Examiner*—Cassandra H. Davis
(74) *Attorney, Agent, or Firm*—Kolisch, Hartwell, Dickinson, McCormack & Heuser

(57) ABSTRACT

A hand-held portable sign employs pulsed light to increase visibility. A battery compartment is located remotely from the upper portion of the sign. Flaps are defined in a flexible sign expanse to allow wind to pass through.

11 Claims, 1 Drawing Sheet

HAND-HELD PORTABLE ROAD SIGN

FIELD OF THE INVENTION

The invention relates to portable signs. In particular, the invention involves a portable sign for directing motor vehicle traffic. The sign has enhanced visibility, is easy to hold for extended periods of time, and is less affected by wind compared to previous hand-held signs.

BACKGROUND OF THE INVENTION

Many road-side situations require signs to convey information to motorists. For example, road workers hold signs to direct traffic that is approaching a work area. Portable road signs are also used to warn motorists of accidents down the road. Road signs may be used to indicate detours, as well as road obstacles or weather conditions, for example, mudslides and ice.

Sometimes it is necessary for a person to hold a sign for an extended period of time which may cause the person to become fatigued due in part to the weight and instability of a relatively heavy sign, particularly in gusty weather conditions. Moreover, holding road signs on or near a road is inherently dangerous because the person holding the sign is exposed, and relies on motor vehicle operators to view and respond appropriately to the sign. It is highly desirable that road signs be visible from a long distance because motorists, for example, on highways, may travel at high speeds until the road sign catches the driver's attention. Until that point, the driver may be proceeding at a speed of 65 mph or faster. By the time the motorist spots the sign, there may not be enough time to stop safely.

Many hand-held road signs are not visible enough, particularly when the signs are being used in reduced daylight or when bad weather adversely effects visibility of the sign. In order to enhance visibility some signs include lights. For example, U.S. Pat. Nos. 5,755,051 and 5,023,607 describe signs that include lights disposed in or around the sign expanse. However, the signs shown in these patents require power supplies that either add substantial weight to the upper portion of the sign or are connected asymmetrically to the sign, thereby making the sign significantly harder to hold over long periods.

Another problem with hand-held signs is that the sign expanse must be relatively large so that it can be viewed from a distance. However, the larger the expanse the more affected it is by wind. Intermittent wind or gusts may make the sign harder to hold steady, which in turn may cause the sign to be harder to see, and more tiresome to hold for long periods.

Accordingly, an object of the present invention is to provide a hand-held sign that is highly visible to an approaching motorist.

Another object of the invention is to design a road sign that is lightweight and easy to hold for hours at a time.

Still another object of the invention is to provide a hand-held sign that is minimally effected by wind gusts without substantially sacrificing visibility of the sign expanse.

SUMMARY OF THE INVENTION

The above objects are achieved with a portable hand-held sign that utilizes a flexible sign expanse. A message is displayed on at least one side of the sign expanse. The sign expanse has at least one flap, preferably numerous flaps, for permitting wind to pass through the sign expanse. The sign expanse is detachably connected to a rigid frame so that the message on the sign expanse is clearly displayed. A pole structure has a top portion and a bottom portion. The frame is connected to the top portion of the pole structure. A light is located adjacent the sign expanse for improving visibility of the sign. Reflectors may be used to focus and direct light toward the motorist. A battery compartment is positioned remotely from the upper portion of the pole structure, preferably near the bottom of the pole. The battery compartment is equipped with contacts that are electrically connected to the light.

DESCRIPTION OF THE INVENTION

The invention provides a hand-held sign that is easier to hold for long periods of time and more visible, as viewed from long distance by oncoming motorists. Preferred embodiments of the invention are versatile because they allow different sign expanses to be interchanged on the same basic frame and pole structure. The invention also provides a wind release mechanism to reduce off-centering effects of wind on the sign.

Figure 1:
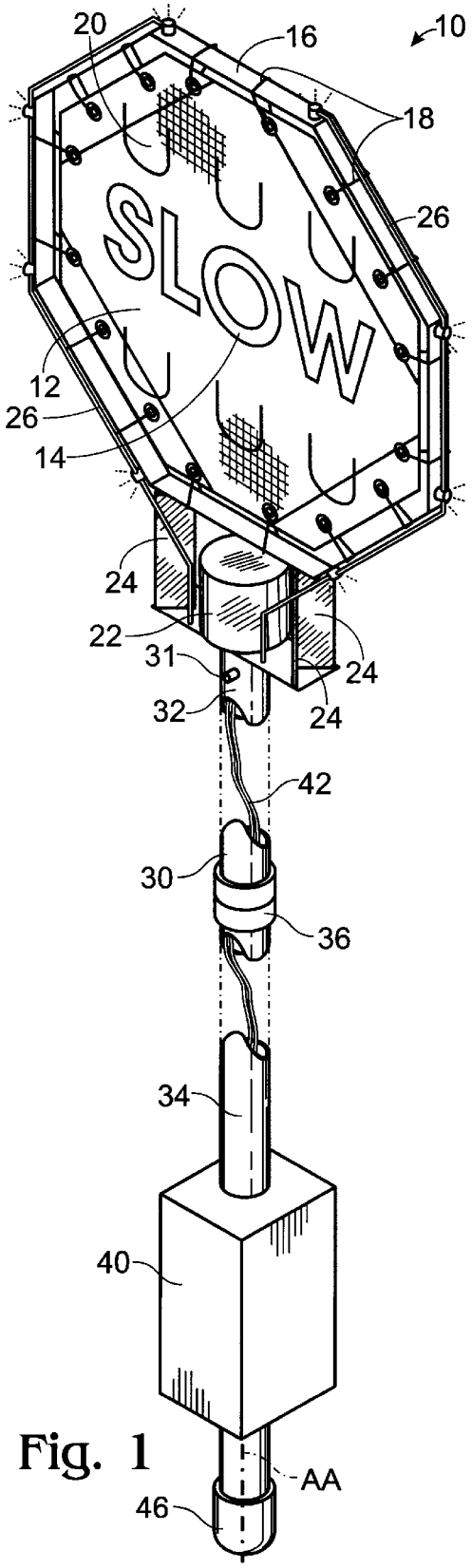
FIG. 1 is a perspective view showing a front side of a hand-held portable sign according to a preferred embodiment of the invention.

FIG. 1 shows a hand-held sign 10. Sign expanse 12 displays message 14, "SLOW." Sign expanse 12 is preferably made of a flexible high strength material such as polyvinyl. Sign expanse 12 is tautly secured to perimetral rigid metal frame 16 via ties 18. Different sign expanses can be interchangeably secured onto frame 16. Flaps 20 are cut into sign expanse 12 to permit wind to pass through sign expanse 12. When wind is not blowing, flaps 20 remain in the plane of sign expanse 12 so that the visible surface area of sign expanse 12 is maximized.

Light 22 is positioned immediately below sign expanse 12. Light 22 is preferably a strobe light, however, it may also be a constant light. Light 22 is also amber or clear so that it does not cause confusion relative to the message displayed on sign expanse 12.

Reflective panels 24 are positioned on opposite lateral sides of light 22 for focusing light and enhancing visibility of light 22 from the perspective of an approaching motorist. In a preferred embodiment, reflective panels 24 extend in planes that form angles of approximately 45-degrees relative to the plane of sign expanse 12. Fiber optics 26 channel light emitted by the light device to additional locations around sign expanse.

Pole 30 extends downward from light 22, and is preferably made of lightweight material such as PVC pipe. A push-button switch 31 is provided on a side of pole 30 for turning light 22 on and off. Pole 30 has an upper portion 32 adjacent light 22, and a lower portion 34 which extends to the ground. Upper portion 32 and lower portion 34 of pole 30 are linked via a connector 36 which allows the pole portions to be rigidly, colinearly, connected when the sign is in use, and disconnected for compact storage or transport. Connector mechanism 36 preferably does not require twisting of the pole portions relative to each other, but instead uses a clamp or bolt device to secure the connection so that it is not necessary to twist the wires inside the pole.

Battery compartment 40 is located along bottom portion 34 of pole 30. It is important for battery compartment 40 to be located remotely from upper portion 32 of the pole 30 and sign expanse 12 so that the overall center of gravity of the sign is as low as possible. It is also important to position battery compartment 40 in a substantially symmetrical location relative to axis AA in the core of pole 30 so that the relatively heavy battery does not cause a significant moment urging the sign off-center from the desired vertical position. Even a small moment may make the sign much harder to hold up over a long period of time.

Electrical wires 42 run through pole 30 to connect contacts inside battery compartment 40 to light 22. In an alternative embodiment, batteries for light 22 may be contained in a pouch, belt, or backpack worn by the sign holder. A non-skid pole cap 46 is positioned at the lowest end of pole 30 to assist maintenance of the sign position relative to the ground.

Figure 2:
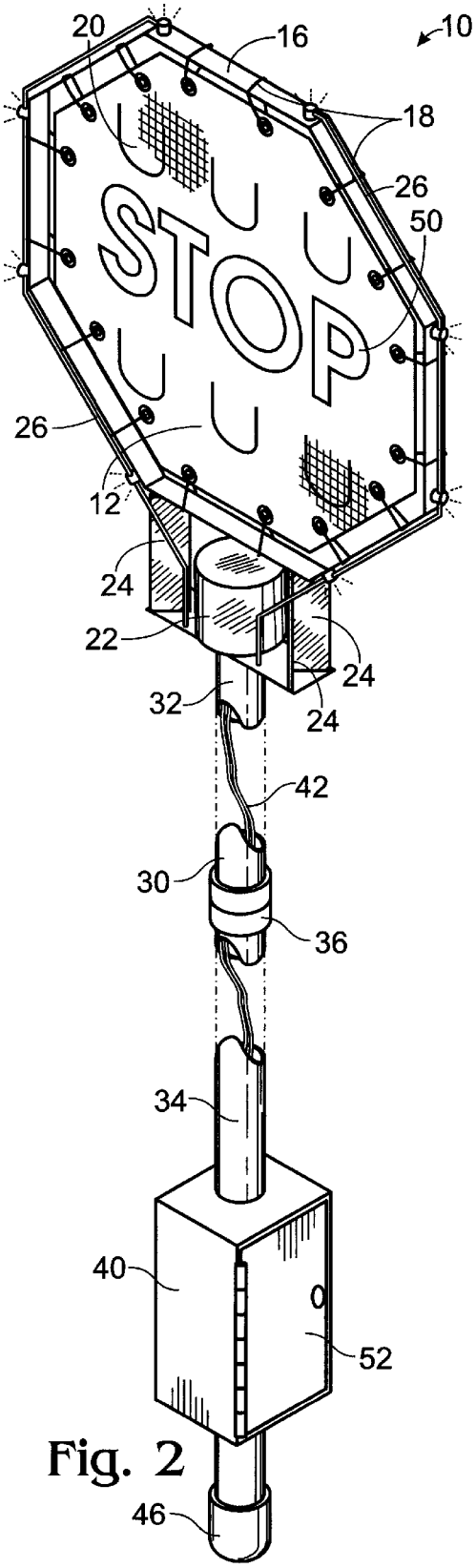
FIG. 2 is a perspective view showing an opposing side of the sign shown in FIG. 1.

FIG. 2 shows the same sign 10 illustrated in FIG. 1, except the sign has been rotated 180-degrees to illustrate the opposite side. The same sign 10 signals "SLOW" on one side, and "STOP" on the other side. The words on each side of the sign are preferably created using highly-visible, reflective, easy-to-read lettering. Most of the elements of sign 10 that are illustrated in FIG. 2 have already been described above. Sign expanse 12 displays a "STOP" instruction 50.

Light 22 may be the same light that projects on the other side of the sign. Thus, light 22 would always pulse and project symmetrically on both sides of the sign, regardless of which side of the sign is facing oncoming motorists. Alternatively, light 22 may be two separate lights, one for each side, situated in different cases or compartments, or may be two light elements contained in one housing.

Battery compartment 40, as shown in FIG. 2, has a hinged door 52 permitting access to compartment 40 for changing or servicing the battery. The battery is preferably a 12-volt rechargeable cell that can be used to power a pulsed light of 21–24 watts per pulse, at a frequency of 70–80, for at least 8 hours without recharging.

Although the invention has been disclosed in its preferred forms, the specific embodiments thereof as disclosed and illustrated herein are not to be considered in a limiting sense, because numerous variations are possible. Applicant regards the subject matter of his invention to include all novel and nonobvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to the original claims, also are regarded as included within the subject matter of applicant's invention.

I claim:

1. A portable sign comprising a flexible sign expanse having a message displayed on at least one side of the sign expanse, the sign expanse having a wind-release mechanism that permits wind to pass through the sign expanse, a rigid frame, the sign expanse being detachably connected to the frame so that the message is clearly displayed, a pole structure connected to the frame, a light device adjacent the sign expanse for improving the visibility of the sign, fiber optics configured to channel light emitted by the light device to additional locations around the sign expanse, and a battery compartment equipped with contacts that are electrically connected to the light device.

2. The portable sign of claim 1, wherein the light device emits pulsed light.

3. The portable sign of claim 1, wherein a battery compartment is connected to a bottom portion of the pole structure.

4. The portable sign of claim 3, wherein the battery compartment is positioned substantially symmetrically relative to a core axis of the pole structure.

5. The portable sign of claim 1 further comprising reflectors positioned adjacent the light device configured to direct light toward a motorist approaching the sign by increasing the attention-getting capability of the light device.

6. The portable sign of claim 1, wherein the message on the sign expanse is composed of reflective letters.

7. The portable sign of claim 1, wherein the light device emits substantially colorless light.

8. The portable sign of claim 1, wherein the light device is located between the pole structure and the sign expanse.

9. The portable sign of claim 1, wherein the rigid frame is made of metal.

10. The portable sign of claim 1, wherein the sign expanse is made of high strength polyvinyl.

11. The portable sign of claim 1, wherein the top and bottom portions of the pole structure can be disconnected so that the sign can be compactly stored or transported.

* * * * *